US005702060A

United States Patent [19]

Matteazzi et al.

[11] Patent Number: 5,702,060

[45] Date of Patent: Dec. 30, 1997

[54] HIGH-ENERGY HIGH-CAPACITY OSCILLATING BALL MILL

[76] Inventors: Paolo Matteazzi, Via Pinelli 23/B, 31100 Treviso; Diego Basset, Via Roma 6, 31020 San Vendemiano, both of Italy

[21] Appl. No.: 424,373

[22] PCT Filed: Oct. 28, 1993

[86] PCT No.: PCT/EP93/03000

§ 371 Date: Apr. 25, 1995

§ 102(e) Date: Apr. 25, 1995

[87] PCT Pub. No.: WO94/09907

PCT Pub. Date: May 11, 1994

[30] Foreign Application Priority Data

Oct. 30, 1992 [IT] Italy ..... TV92A0126

[51] Int. Cl.[6] ..... B02C 19/16

[52] U.S. Cl. ..... 241/175; 241/179

[58] Field of Search ..... 241/65, 175, 179

[56] References Cited

U.S. PATENT DOCUMENTS

| | | | |
|---|---|---|---|
| 3,272,443 | 9/1966 | Reiners | 241/175 X |
| 3,310,245 | 3/1967 | Decker et al. | 241/175 X |
| 3,433,421 | 3/1969 | Moore . | |
| 4,085,898 | 4/1978 | Jacubasch et al. | 241/175 |
| 4,164,328 | 8/1979 | Kausel et al. | 241/175 |
| 4,625,921 | 12/1986 | Blundell | 241/14 |
| 5,193,754 | 3/1993 | Pujol | 241/65 |

FOREIGN PATENT DOCUMENTS

| | | |
|---|---|---|
| 1 108 574 | 9/1981 | Canada . |
| 2 099 414 | 3/1972 | France . |
| 2 315 998 | 1/1977 | France . |
| 35 00 211 | 7/1986 | Germany . |

OTHER PUBLICATIONS

Kirk–Othmer, Encyclopedia of Chemical Technology, 3rd Ed., vol. 21, pp. 132–216. (no date given).

*Primary Examiner*—John M. Husar
*Attorney, Agent, or Firm*—Kenyon & Kenyon

[57] ABSTRACT

The present invention concerns a high energy oscillating ball mill, useful in the preparation of nanophase materials having crystallite sizes of the order of 5 to 20 nm, with high production capacity and consisting of a grinding jar (containing, in the working conditions, the grinding balls and the materials charge to be processed) driven in an alternate regime of motion. Such a grinding jar is elastically constrained in such a way that the inertial forces originated during the oscillations are compensated.

18 Claims, 1 Drawing Sheet

HIGH-ENERGY HIGH-CAPACITY OSCILLATING BALL MILL

TECHNICAL FIELD

The present invention concerns a high energy ball mill and in particular an oscillating mill having high production capacity. It is possible to use such a mill for example in the preparation of nanophase materials.

Nanophase materials are characterized by crystal sizes in the range 5 to 20 nm. Such materials can be constituted by single metals, alloys, compounds or composites (for example alloy/metal-oxide, alloy/metal-carbide).

The preparation of such materials can be performed in high energy mills (high local impact energies are in fact required).

BACKGROUND ART

Conventional high energy mills include, for example: autogenous grinders, abrasion grinders, gas jet or liquid jet disintegrators, ball anular mills, vibratory ball mills, planetary ball mills and oscillating ball mills.

For a more complete description of these mills, reference may be made to "Kirk-Othmer, Encyclopedia of Chemical Technology, 3rd edition, vol. 21, p 132 to 161".

DE-A-3,500,211 describes a ball mill wherein a system of springs compensate the gravity forces, CA-A-1,108,574 describes a ball mill with means for conducting oscillation from a mechanical oscillator, U.S. Pat. No. 3,433,421 describes a vibratory mill comprising a drum mounted on a shaft driven through an orbit described by oscillative movement along and about the major axis of said driven shaft.

In the present state of development of mills technology it is not possible to have at the same time: 1) high impact speeds of the grinding means; 2) high specific pressures in the impact zones; 3) high impact frequencies for each grinding means; and 4) high production capacity.

Existing milling systems are therefore scarcely or ill suited for the fast preparation of nanophase materials in large quantities.

SUMMARY OF THE INVENTION

It is an object of the present invention to achieve a mill in which an advantageous combination of the above characteristics is achieved.

It is also an aim of the present invention to achieve a system for the production of nanophase materials powders in large quantities.

It is also a further object of the present invention to achieve the fast milling of solids.

An advantage of the present invention is to allow the production of large quantities of nanophase materials for the further consolidation processes.

According to the present invention there is provided an oscillating mill consisting of a grinding jar (containing, in the working condition, the grinding balls and the materials charge to be processed) driven in an alternate regime of motion. Such a grinding jar is elastically constrained in such a way that the inertial forces originated during the oscillations, and acting on the driving system, are compensated.

BRIEF DESCRIPTION OF THE DRAWINGS

In the following an illustrative and not limitative embodiment of the invention is given, with the help of FIGS. 1 and 2.

The FIG. 1 shows a plan view of the grinding jar with elastic compensation system;

Figure 2:
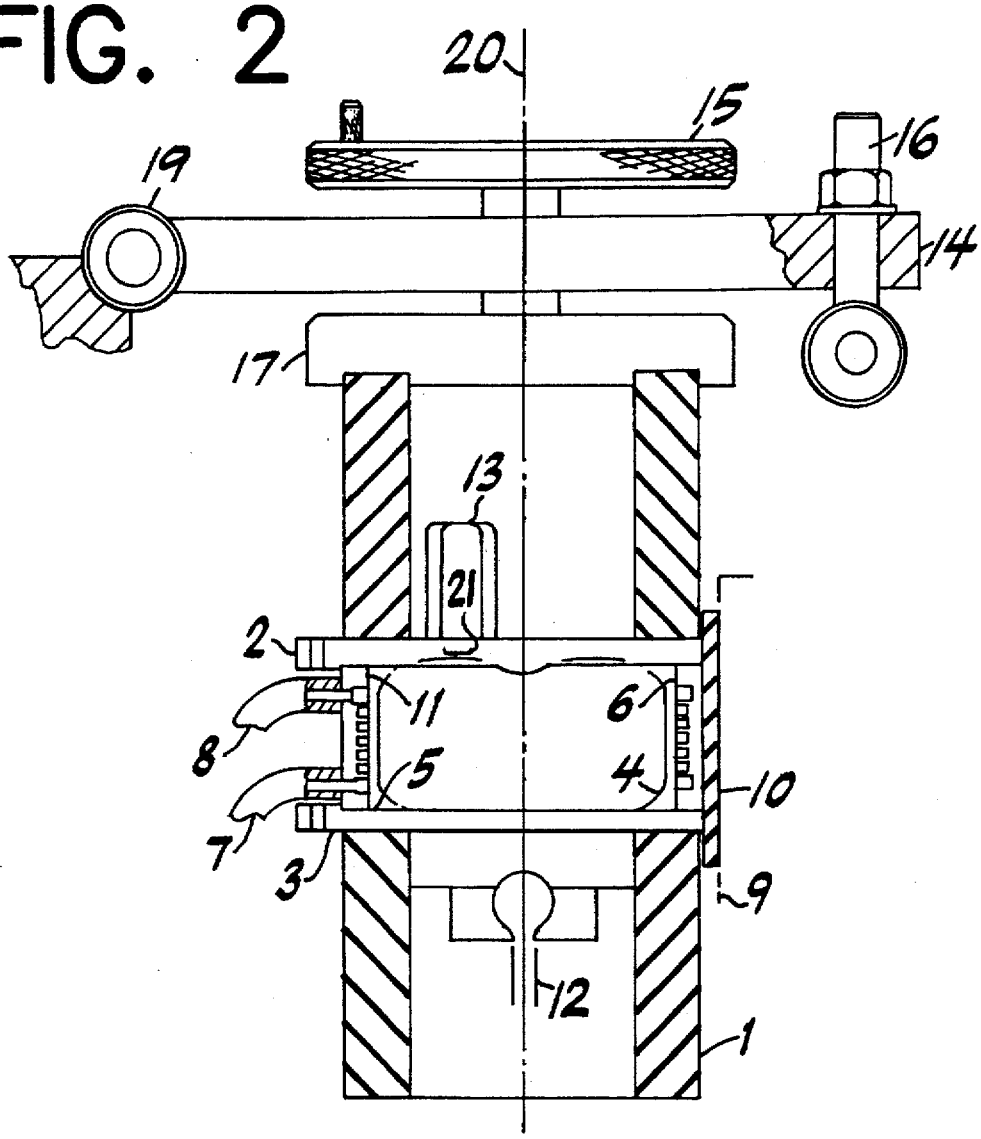
Figure 1:
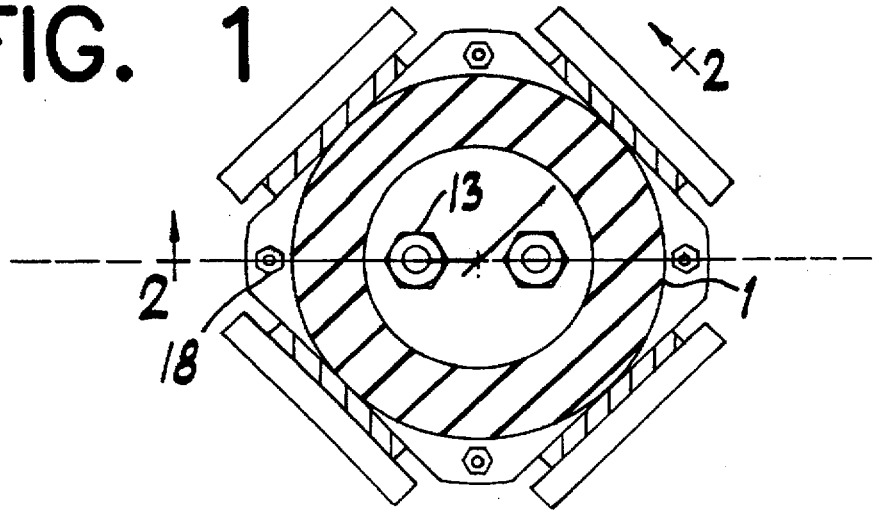

the FIG. 2 shows a cross-section of FIG. 1 along the plane A—A and the pre-loading apparatus of the elastic system.

DESCRIPTION OF THE PREFERRED EMBODIMENTS

In FIGS. 1 and 2 the same part or parts performing the same functions bear the same numbers. In FIG. 1, 1 is the elastic system for the compensation of the inertial forces and consists of a spring of an elastomeric material. In FIG. 2, another (counteracting) spring is located on the other side of the grinding jar which is constituted by the following components: a top cap 2; a bottom cap 3; a lateral wall 4 with provision for seals 5 with the seals 11 with the lateral cooling mantle system 6.

The cooling mantle system 6 is constituted by an internal finning (on the side of the lateral jar wall 4) in which a cooling fluid is allowed to circulate with inlet in 7 and outlet in 8.

The seals 11 act for the cooling fluid whereas seals 5 have the purpose to allow the control of the internal jar atmosphere (vacuum, inert or reactive gases) performed by means of valve 13 passing through opening 21.

In the caps 2 and 3 are located joint systems 18 by tie rods. The grinding jar, constituted by the above components, is placed in contact with springs 1 by a spring pre-loading system constituted of a spring housing plate 17, pre-loading calibrated handwheel 15, bearing plate 14 overturnable on the hinge 19, fastening screw 16.

The working principle of the mill is based on the drive of the set jar-springs by a ball joint 12 in alternating motion substantially along an axis 20 with sinusoidal-like law. The lateral guiding system consists of bearing plates 9 of guides 10 in low friction coefficient materials. The grinding jar is charged before with the material to be processed and the grinding balls.

In a practical embodiment of the present invention: the grinding jar has a diameter of 300 mm; charge capacity of 1 kg of material to be processed; motion induced by a kinematic mechanism connecting-rod crank; oscillation frequency 17 Hz; oscillation amplitude 30 mm; internal jar volume 5000 $cm^3$. The maximum inertial forces during the oscillation of the grinding jar with the total charge (materials to be processed plus grinding balls) are of the order of 1200 kg. Such forces, which have also a sinusoidal-like behaviour, are partially (70% or more) compensated by springs 1 (having elastic constant 40 kg/mm) in such a way that the residual load on the joint 12 can be sustained along all the oscillation cycle.

In a typical oscillating ball mill according to the present invention having an internal jar volume above 200 $cm^3$, more particularly above 5000 $cm^3$:

(a) the motion components perpendicular to axis 20 do not exceed in amplitude the 20% of the motion components along axis 20;

(b) there is a compensation of at least the 70% of the inertial forces components generated by the grinding jar 2, 3, 4 along the axis 20;

(c) the jar oscillating amplitudes along the axis 20 are greater than 20 mm and jar oscillation frequencies along the axis 20 are greater than 10 Hz.

In a further not limitative embodiment of the invention the grinding jar is constituted of hardened steel (components 2, 3, 4), the lateral mantle 6 is of aluminium and guides 10 are made of teflon.

It has been therefore described a preferential description of the invention, but other variants are possible.

It is easily feasible to increase in the production capacity of the mill by increasing the dimension (for example the diameter) of the grinding jar and modifying accordingly the elastic system for the compensation of inertial forces.

It is possible, for example, to utilize an elastic system, to compensate the inertial forces, constituted of springs made of metallic alloys or composite materials. Dissipative systems to compensate the inertial forces by a compressed fluid can be well utilized (such as for example gas or oil or water shock absorbers). It is also possible to use a mixed elastic-dissipative system.

It is also possible, for example, to utilize other alternative motion driving systems such as cams, compound levers, hydraulic or hydraulic systems with proportional valves.

It is also possible to utilize other alternative motion driving systems in variable regime as regarding the width/frequency of the oscillation and wave shapes.

It is possible, for example, to utilize for the guides 10 other solutions compatible with a low friction coefficient (lubricated or self-lubricated guides, materials having low friction coefficient). It is also possible not to utilize a guiding system, once provided a limitation of the non-axial components of the motion.

It is possible, for example, not to provide a jar cooling circuit as the jar itself could be cooled by natural convection.

It is possible, for example, to shape differently the internal jar surfaces in order to limit the extension of preferential ball impact zones.

It is possible, for example, to increase the productivity to utilize, instead of a single jar 2, 3, 4, multiple-constrained (each other) jars.

It is also possible to utilize other pre-loading 14, 15, 16, 17, 19 systems such as mechanical systems by compound lever, wedge or hydraulic jacks.

It is also possible to vary materials, shapes, sizes and proportions, all of this being possible for a person skilled in the art without departing thereby from the scope of the inventive idea of the invention.

We claim:

1. An oscillating ball mill comprising a driving system, a grinding jar, a bearing system, and an elastic system, wherein said driving system and said elastic system are in direct contact with said grinding jar, said elastic system compensates the inertial forces resulting from the operation of said driving system, and the grinding jar motion is substantially along an axis.

2. The oscillating ball mill according to claim 1, wherein the driving system moves along said axis in a sinusoidal-like manner.

3. The oscillating ball mill according to claim 1, further comprising a dissipative system to supplement said elastic system in compensating said inertial forces.

4. The oscillating ball mill according to claim 1, wherein said elastic system comprises springs of elastomeric material.

5. The oscillating ball mill according to claim 1, wherein:

the motion components perpendicular to said axis do not exceed in amplitude the 20% of the motion components along said axis;

said elastic system compensates at least 70% of said inertial forces; and the jar oscillating amplitudes along said axis are greater than 20 mm and jar oscillation frequencies along said axis are greater than 10 Hz.

6. The oscillating ball mill according to claim 1, wherein said driving system is a connecting rod-crank kinetic mechanism.

7. The oscillating ball mill according to claim 1, having more than one jar constrained together.

8. The oscillating ball mill according to claim 1, wherein the jar motion is guided by guides.

9. The oscillating ball mill according to claim 1, wherein the internal walls of said grinding jar are shaped to limit the existence of preferential impact zones.

10. The oscillating ball mill according to claim 1, wherein said elastic system is pre-loaded by a mechanical system.

11. The oscillating ball mill according to claim 1, wherein said grinding jar is cooled by fluid circulation.

12. The oscillating ball mill according to claim 1, wherein the atmosphere in said grinding jar is controlled by at least one valve passing through at least one opening in said jar.

13. The oscillating ball mill according to claim 1, wherein the internal jar volume is greater than 200 $cm^3$.

14. The oscillating ball mill according to claim 1, wherein said elastic system comprises springs of a metallic alloy.

15. The oscillating ball mill according to claim 1, wherein said elastic system comprises springs of a composite material.

16. The oscillating ball mill according to claim 1, wherein said driving system is a compound lever.

17. The oscillating ball mill according to claim 1, wherein said driving system is a hydraulic drive.

18. The oscillating ball mill according to claim 1, wherein the internal jar volume is greater than 5000 $cm^3$.

* * * * *